US010707554B2

(12) United States Patent
Talty et al.

(10) Patent No.: US 10,707,554 B2
(45) Date of Patent: Jul. 7, 2020

(54) WIDEBAND TRANSPARENT ELLIPTICAL ANTENNA APPLIQUE FOR ATTACHMENT TO GLASS

(71) Applicant: GM GLOBAL TECHNOLOGY OPERATIONS LLC, Detroit, MI (US)

(72) Inventors: Timothy J. Talty, Beverly Hills, MI (US); Amit M. Patel, Santa Monica, CA (US); Keerti S. Kona, Woodland Hills, CA (US); James H. Schaffner, Chatsworth, CA (US); Hyok Jae Song, Oak Park, CA (US); Duane S. Carper, Davison, MI (US); Eray Yasan, Canton, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 66 days.

(21) Appl. No.: 15/583,294

(22) Filed: May 1, 2017

(65) Prior Publication Data

US 2017/0324142 A1 Nov. 9, 2017

Related U.S. Application Data

(60) Provisional application No. 62/332,649, filed on May 6, 2016.

(51) Int. Cl.
*H01Q 21/28* (2006.01)
*H01Q 1/12* (2006.01)
(Continued)

(52) U.S. Cl.
CPC ..... *H01Q 1/1271* (2013.01); *H01Q 1/241* (2013.01); *H01Q 1/3291* (2013.01); *H01Q 1/48* (2013.01);
(Continued)

(58) Field of Classification Search
CPC ..... H01Q 1/1271; H01Q 1/38; H01Q 1/48; H01Q 13/203; H01Q 13/206; H01P 5/028;
(Continued)

(56) References Cited

U.S. PATENT DOCUMENTS 4,291,312 A * 9/1981 Kaloi ..... H01Q 1/48 343/700 MS
5,898,407 A * 4/1999 Paulus ..... B32B 17/10 343/713
(Continued)

OTHER PUBLICATIONS

Panda, Jyoti Ranjan et al. "A Compact CPW-Fed Hexagonal 5 GHz/6 GHz Band-Notched Antenna with an U-Shaped Slot for Ultrawideband Communication Systems" Signal Processing and Communications (SPCOM), 2010 International Conference, Jul. 18-21, 2010, IEEE.
(Continued)

*Primary Examiner* — Hai V Tran
*Assistant Examiner* — Bamidele A Jegede
(74) *Attorney, Agent, or Firm* — Cantor Colburn LLP

(57) ABSTRACT

A thin film, flexible, co-planar waveguide (CPW), antenna structure suitable to be mounted on vehicle glass and that has particular application for MIMO LTE applications in, for example, the 0.46-3.8 GHz frequency band. The antenna structure includes a planar antenna formed on a substrate that includes a ground plane having an elliptical cut-out slot section defined within an outer perimeter portion of the ground plane and an antenna radiating element extending into the slot from the perimeter portion.

21 Claims, 3 Drawing Sheets

(51) Int. Cl.

| | |
|---|---|
| ***H01Q 5/371*** | (2015.01) |
| ***H01Q 5/378*** | (2015.01) |
| ***H01Q 9/28*** | (2006.01) |
| ***H01Q 1/32*** | (2006.01) |
| ***H01Q 13/20*** | (2006.01) |
| ***H01Q 1/24*** | (2006.01) |
| ***H01Q 1/48*** | (2006.01) |
| ***H01Q 1/52*** | (2006.01) |
| ***H01Q 9/04*** | (2006.01) |
| ***H01Q 21/00*** | (2006.01) |

(52) U.S. Cl.
CPC ..... *H01Q 1/523* (2013.01); *H01Q 5/371* (2015.01); *H01Q 5/378* (2015.01); *H01Q 9/045* (2013.01); *H01Q 9/0407* (2013.01); *H01Q 9/28* (2013.01); *H01Q 13/20* (2013.01); *H01Q 21/00* (2013.01); *H01Q 21/28* (2013.01)

(58) Field of Classification Search
CPC . H01P 5/085; H01R 12/7076; H01R 2201/02; H01R 2201/26
See application file for complete search history.

(56) References Cited

U.S. PATENT DOCUMENTS 6,278,410 B1 * 8/2001 Soliman ..... H01Q 1/38 343/700 MS
6,590,545 B2 * 7/2003 McCorkle ..... H01Q 9/40 343/700 MS
6,710,748 B2 * 3/2004 Yarasi, Sr. ..... H01Q 1/241 343/700 MS
7,233,296 B2 6/2007 Song et al.
2002/0122010 A1 * 9/2002 McCorkle ..... H01Q 9/40 343/767
2003/0034926 A1 * 2/2003 Veerasamy ..... H01Q 1/1271 343/713
2005/0052334 A1 3/2005 Ogino et al.
2005/0156787 A1 * 7/2005 Myoung ..... H01Q 1/38 343/700 MS
2007/0040756 A1 * 2/2007 Song ..... H01Q 1/1271 343/713
2011/0032155 A1 * 2/2011 Yanagi ..... H01Q 1/48 343/700 MS
2012/0154229 A1 * 6/2012 Kagaya ..... H01Q 1/1271 343/713
2013/0021207 A1 * 1/2013 Lee ..... H01Q 1/38 343/700 MS
2013/0285861 A1 * 10/2013 Kagaya ..... H01Q 1/1271 343/712
2014/0104122 A1 * 4/2014 Lee ..... H01Q 1/1271 343/713

OTHER PUBLICATIONS

Office Action for Chinese Application No. 201710317629.2; Application Filing Date May 8, 2017; dated Mar. 11, 2019 (9 pages).

* cited by examiner

WIDEBAND TRANSPARENT ELLIPTICAL ANTENNA APPLIQUE FOR ATTACHMENT TO GLASS

CROSS-REFERENCE TO RELATED APPLICATIONS

This application claims the benefit of the priority date of U.S. Provisional Patent Application Ser. No. 62/332,649, titled, Wideband Transparent Elliptical Antenna for Applique for Attachment to Glass, filed May 6, 2016.

BACKGROUND OF THE INVENTION

Field of the Invention

This invention relates generally to a thin film, flexible, wideband antenna configured on a dielectric substrate and, more particularly, to a thin film, flexible, wideband co-planar waveguide (CPW) antenna including a specially configured antenna radiating element positioned within an elliptical slot that provides for multiple-input multiple-output (MIMO) long term evolution (LTE) 4G cellular applications, where the antenna can include transparent conductors so as to allow the antenna to be adhered to vehicle glass.

Discussion of the Related Art

Modern vehicles employ various and many types of antennas to receive and transmit signals for different communications systems, such as terrestrial radio (AM/FM), cellular telephone, satellite radio, dedicated short range communications (DSRC), GPS, etc. The antennas used for these systems are often mounted to a roof of the vehicle so as to provide maximum reception capability. Further, many of these antennas are often integrated into a common structure and housing mounted to the roof of the vehicle, such as a "shark-fin" roof mounted antenna module. As the number of antennas on a vehicle increases, the size of the structures required to house all of the antennas in an efficient manner and providing maximum reception capability also increases, which interferes with the design and styling of the vehicle. Because of this, automotive engineers and designers are looking for other suitable areas on the vehicle to place antennas that may not interfere with vehicle design and structure.

One of those areas is the vehicle glass, such as the vehicle windshield, which has benefits because glass typically makes a good dielectric substrate for an antenna. For example, it is known in the art to print AM and FM antennas on the glass of a vehicle where the printed antennas are fabricated within the glass as a single piece. However, these known systems are generally limited in that they can only be placed in a vehicle windshield or other glass surface in areas where viewing through the glass is not necessary.

Cellular systems are currently expanding into 4G long term evolution (LTE) that requires multiple antennas to provide multiple-input multiple-output (MIMO) operation, which provides greater data throughput and bandwidth than previous cellular communications technologies, such as 2G and 3G. LTE 4G cellular technology employs MIMO antennas at the transmitter and the receiver that provide an increase in the number of signal paths between the transmitter and the receiver, including multipath reflections off of various objects between the transmitter and the receiver, which allows for the greater data throughput. As long as the receiver can decouple the data being received on each path at the MIMO antennas where the signals are uncorrelated, then those paths can be used by the receiver to decipher data transmitted at the same frequency and at the same time. Thus, more data can be compressed into the same frequency providing higher bandwidth.

Automobile manufacturers are looking to provide 4G cellular technology in vehicles, which presents a number of design challenges especially if the MIMO antennas are incorporated as part of a common antenna structure mounted to the roof of the vehicle. For example, by housing the MIMO antennas, which include at least two antennas, in the traditional telematics antenna module mounted to the roof of the vehicle, the entire antenna volume of the module would need to increase because of the extra real estate required for the MIMO antennas, which require a low correlation of the received signals at the antennas. In other words, because the signals received by the MIMO antennas need to be significantly uncorrelated, the distance between the antennas needs to be some minimum distance depending on the frequency band being employed. This de-correlation between the antenna ports is often times difficult to achieve in various designs if the antenna elements are located at the same general location because the signals received at the port would be very similar. This problem can be overcome by moving the antennas farther apart.

SUMMARY OF THE INVENTION

The present invention discloses and describes a thin film, flexible, co-planar waveguide (CPW), antenna structure suitable to be mounted on vehicle glass and that has particular application for MIMO LTE applications in, for example, the 0.46-3.8 GHz frequency band. The antenna structure includes a planar antenna formed on a substrate that includes a ground plane having an elliptical cut-out slot section defined within an outer perimeter portion of the ground plane and an antenna radiating element extending into the slot from the perimeter portion.

Additional features of the present invention will become apparent from the following description and appended claims, taken in conjunction with the accompanying drawings.

DETAILED DESCRIPTION OF THE EMBODIMENTS

The following discussion of the embodiments of the invention directed to a thin film, flexible, CPW antenna structure including an elliptical slot applicable for a MIMO LTE cellular system and being suitable to be adhered to a curved dielectric structure is merely exemplary in nature, and is in no way intended to limit the invention or its applications or uses. For example, the discussion herein talks about the antenna structure being applicable to be adhered to automotive glass. However, as will be appreciated by those skilled in the art, the antenna structure will have application for other dielectric structures other than automotive structures and other than transparent or translucent surfaces.

Figure 1:
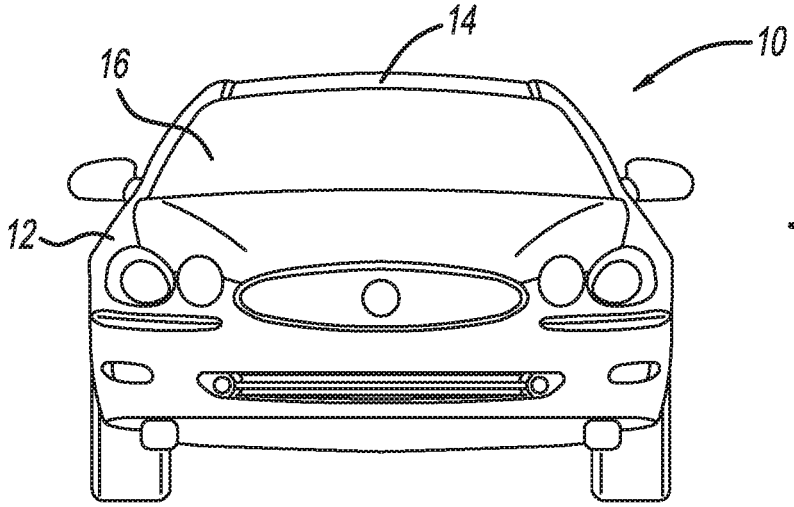
FIG. 1 is front view of a vehicle showing a vehicle windshield.
Figure 2:
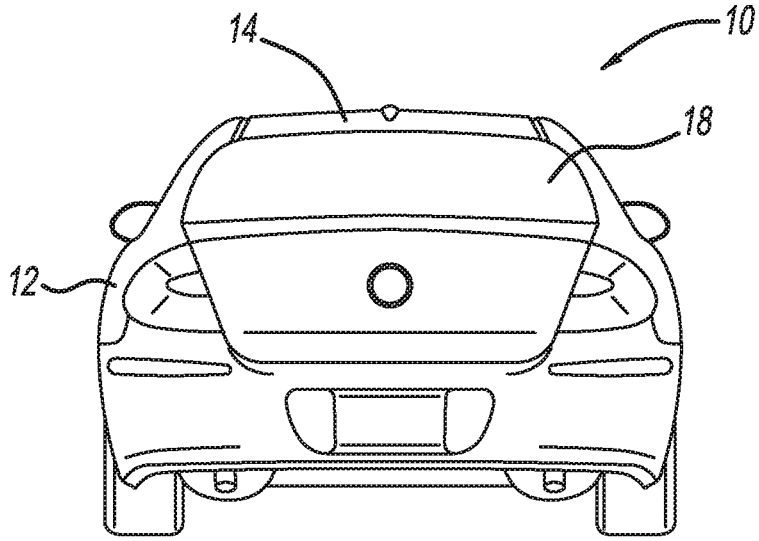
FIG. 2 is a rear view of the vehicle showing a vehicle rear window.

FIG. 1 is a front view of a vehicle 10 including a vehicle body 12, roof 14 and windshield 16, and FIG. 2 is a rear view of the vehicle 10 showing a rear window 18.

As discussed above, it is often desirable to provide antennas on vehicles that are transparent and can be integrated in a conformal manner to the curved windshield or vehicle glass. The present invention proposes an antenna structure that has particular application for MIMO LTE cellular systems operating in, for example, the 0.46-3.8 GHz frequency band when mounted or integrated on the vehicle glass. The antenna structure can be shaped and patterned into a transparent conductor and a co-planar structure where both the antenna and ground conductors are printed on the same layer. The antenna structure can be designed to operate on automotive glass of various physical thicknesses and dielectric properties, where the antenna structure operates as intended when installed on the glass or other dielectric since in the design process the glass or other dielectric is considered in the antenna geometry pattern development.

Figure 3:
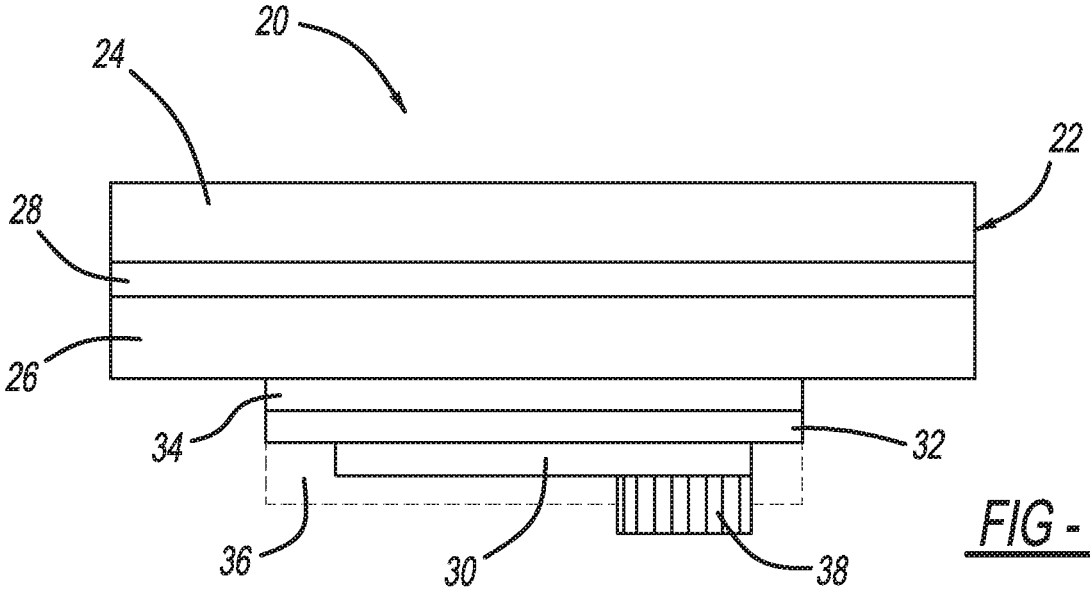
FIG. 3 is a profile view of a vehicle window including a thin, flexible CPW antenna structure formed thereon.

FIG. 3 is a profile view of an antenna structure 20 including a glass substrate 22, such as a vehicle windshield, having an outer glass layer 24, an inner glass layer 26 and a polyvinyl butyral (PVB) layer 28 therebetween. The structure 20 also includes a printed CPW antenna 30 formed on a thin, flexible film substrate 32, such as polyethylene terephthalate (PET), biaxially-oriented polyethylene terephthalate (BoPET), flexible glass substrates, mylar, Kapton, etc., and adhered to a surface of the layer 26 by an adhesive layer 34. The adhesive layer 34 can be any suitable adhesive or transfer tape that effectively allows the substrate 32 to be secured to the glass layer 26, and further, if the antenna 30 is located in a visible area of the glass layer 26, the adhesive or transfer tape can be transparent or near transparent so as to have a minimal impact on the appearance and light transmission therethrough. The antenna 30 can be protected by a low RF loss passivation layer 36, such as parylene. An antenna connector 38 is shown connected to the antenna 30 and can be any suitable RF or microwave connector, such as a direct pig-tail or coaxial cable connection. Although the antenna 30 is shown being coupled to an inside surface of the inner glass layer 26, the antenna 30 can be adhered to the outer surface of the outer glass layer 24 or the surface of the layers 24 or 26 adjacent to the PVB layer 28 or the surfaces of the PVB layer 28.

The antenna 30 can be formed by any suitable low loss conductor, such as copper, gold, silver, silver ceramic, metal grid/mesh, etc. If the antenna 30 is at a location on the vehicle glass that requires the driver or other vehicle occupant to see through the glass, then the conductor can be any suitable transparent conductor, such as indium tin oxide (ITO), silver nano-wire, zinc oxide (ZnO), etc. Performance of the antenna 30 when it is made of a transparent conductor could be enhanced by adding a conductive frame along the edges of the antenna 30 as is known in the art.

The thickness of automotive glass may vary between 2.8 mm-5 mm and have a relative dielectric constant $\in_r$ in the range of 4.5-7.0. The antenna 30 includes a single layer conductor and a co-planar waveguide (CPW) feed structure to excite the antenna radiator. The CPW feed structure can be configured for mounting the connector 38 in a manner appropriate for the CPW feed line or for a pigtail or a coaxial cable. When the connector 38 or the pigtail connection to the CPW line is completed, the antenna 30 can be protected with the passivation layer 36. In one embodiment, when the antenna 30 is installed on the glass layer 26, a backing layer of the transfer tape can be removed. By providing the antenna conductor on the inside surface of the vehicle windshield 22, degradation of the antenna 30 can be reduced from environmental and weather conditions.

Figure 4:
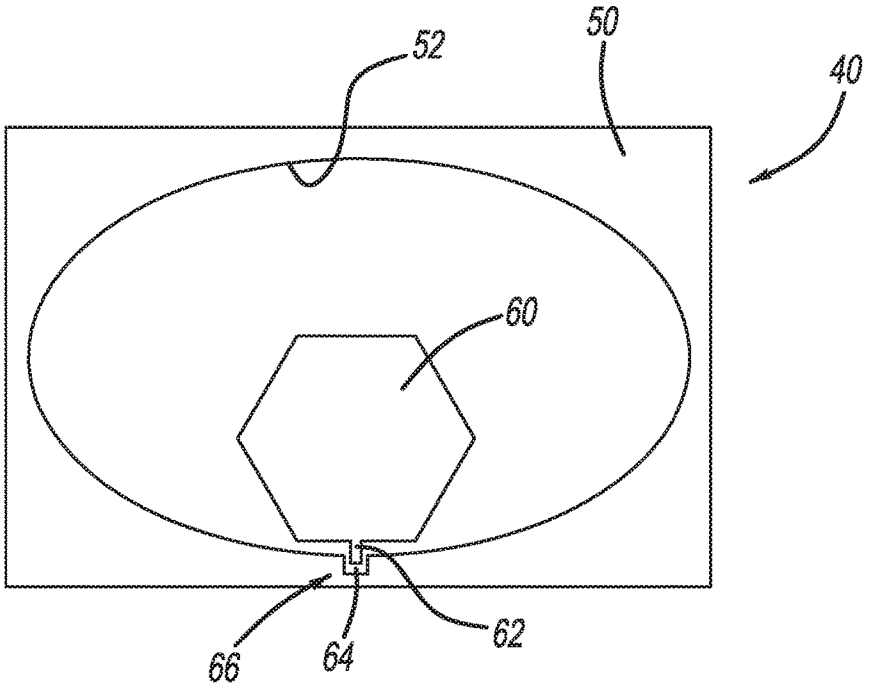
FIG. 4 is a top view of a thin film CPW antenna including an elliptical slot and a hexagonal-shaped antenna radiating element positioned therein.
Figure 5:
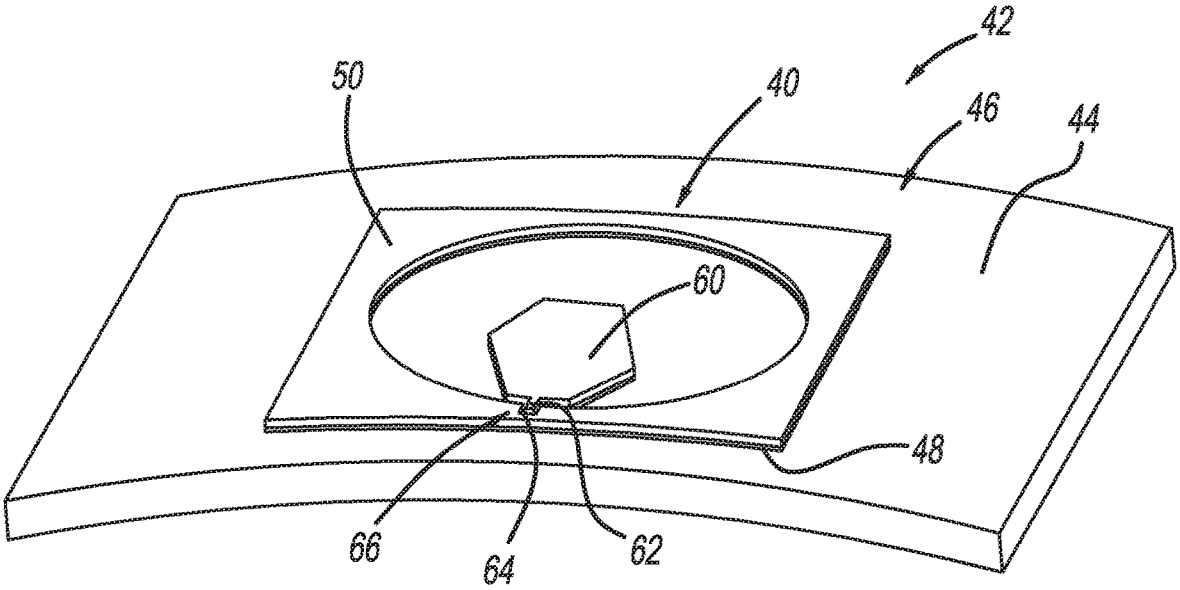
FIG. 5 is an isometric view of the antenna structure shown in FIG. 4 being mounted to a curved vehicle glass.

FIG. 4 is a top view of a thin film, wideband CPW antenna structure 40 that can be used as the antenna 30 and has application to operate in the LTE frequency band, where the antenna structure 40 is of the type discussed herein that can be secured to vehicle glass. For example, FIG. 5 is an isometric illustration 42 of the antenna structure 40 secured to a surface 44 of a curved vehicle glass 46 by an adhesive layer 48. It is noted that the antenna structure 40 would be one of at least two antennas necessary for MIMO LTE operation. The antenna structure 40 includes an outer perimeter conductive ground plane 50 defining a cut-out elliptical slot 52 therein, where the ground plane 50 is patterned on, for example, a thin film mylar substrate (not shown). A hexagonal-shaped antenna radiating element 60 extends into the elliptical slot 52 and includes a signal line 62. The ground plane 50 includes a slot 64 open to the elliptical slot 52, where the signal line 62 extends into the slot 64 and combines with the ground plane 50 to form an antenna element feed structure 66. Signals received by the ground plane 50 generating currents therein that are coupled to the antenna radiating element 60 for the frequency band of interest.

Figure 6:
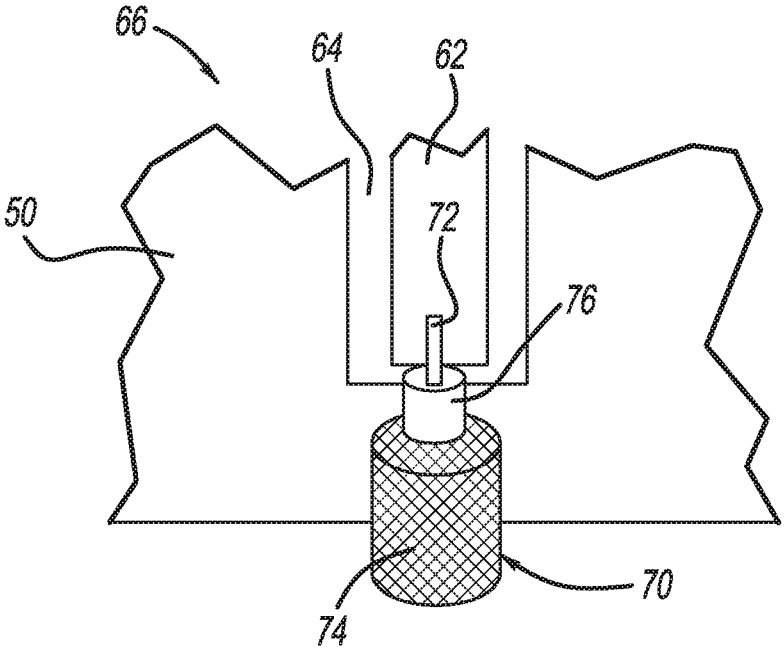
FIG. 6 is an illustration of a CPW antenna feed structure for the antenna radiating element shown in FIG. 4.

Any suitable feed structure can be employed for feeding the antenna element 60. FIG. 6 is top, cut-away view of the CPW antenna feed structure 66 showing one suitable example. In this embodiment, a coaxial cable 70 provides the incoming signal line for the feed structure 66 and includes an inner conductor 72 electrically coupled to the signal line 62 and an outer ground conductor 74 electrically coupled to the ground plane 50, where the conductors 72 and 74 are separated by an insulator 76.

Figure 7:
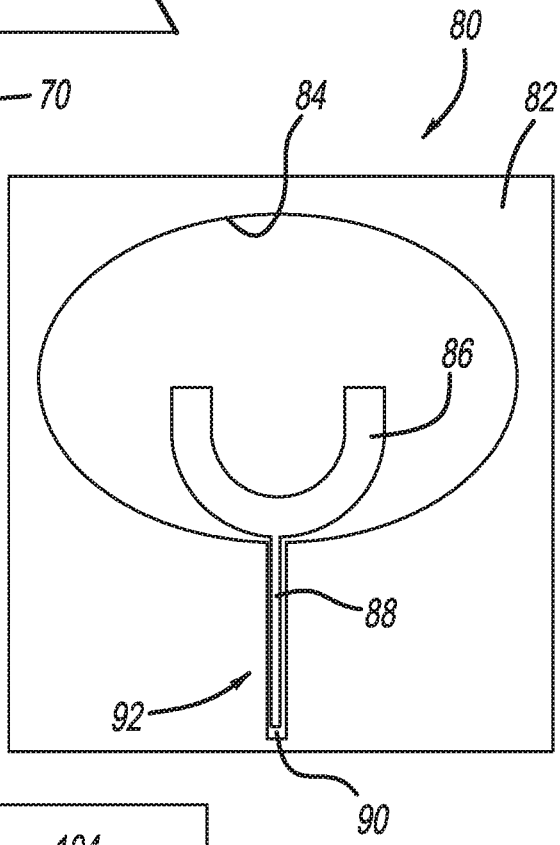
FIG. 7 is a top view of a thin film CPW antenna including an elliptical slot and a U-shaped antenna radiating element therein.

FIG. 7 is a top view of a thin film, wideband CPW antenna structure 80 that also has application to operate in the LTE frequency band and is of the type discussed herein that can be secured to vehicle glass. The antenna structure 80 includes an outer perimeter conductive ground plane 82 defining a cut-out elliptical slot 84 therein, where the ground plane 82 is patterned on, for example, a thin film mylar substrate (not shown). A U-shaped elliptical antenna radiating element 86 extends into the elliptical slot 84 and includes a signal line 88. The ground plane 82 includes a slot 90 open to the elliptical slot 84, where the signal line 88 extends into the slot 90 and combines with the ground plane 82 to form an antenna element feed structure 92.

Figure 8:
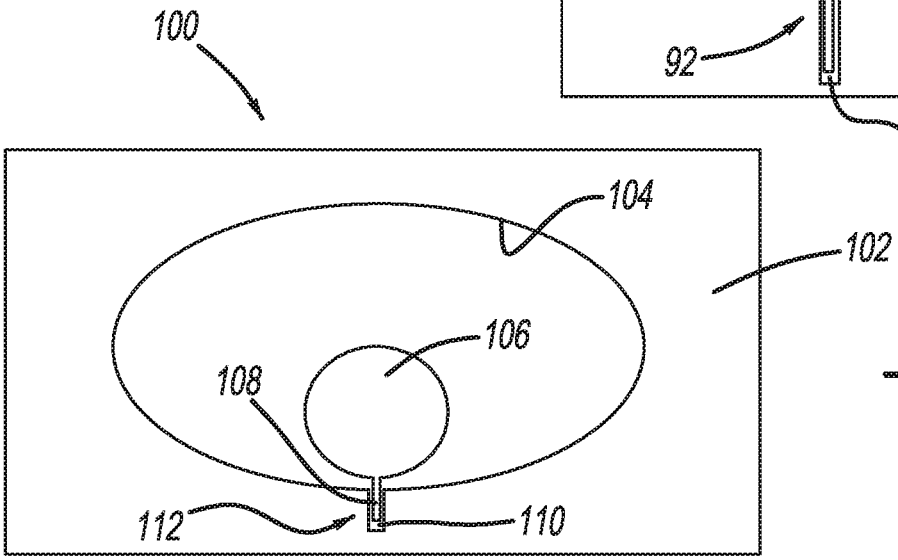
FIG. 8 is a top view of a thin film CPW antenna including an elliptical slot and a circular shaped antenna radiating element therein.

FIG. 8 is a top view of a thin film, wideband CPW antenna structure 100 that also has application to operate in the LTE frequency band and is of the type discussed herein that can be secured to vehicle glass. The antenna structure 100 includes an outer perimeter conductive ground plane 102 defining a cut-out elliptical slot 104 therein, where the ground plane 102 is patterned on, for example, a thin film mylar substrate (not shown). A circular-shaped antenna radiating element 106 extends into the elliptical slot 104 and includes a signal line 108. The ground plane 102 includes a slot 110 open to the elliptical slot 104, where the signal line 108 extends into the slot 110 and combines with the ground plane 102 to form an antenna element feed structure 112.

Each of the antenna radiating elements 60, 86 and 106 is designed to be wideband and operate in the LTE 700 MHz-2400 MHz LTE frequency band. As is apparent, the elliptical slots 52, 84 and 104 for each of the antenna structures 40, 80 and 100 have a different size and shape. The configuration of the slots 52, 84 and 104 would be specific to the shape of the radiating element 60, 86 and 106, respectively, for the wideband use determined through simulation or other techniques. As discussed above, MIMO systems for LTE services generally require two antenna elements that are spaced apart from each so that the signal ports of the antenna elements are not correlated. In the embodiments discussed above, the outer ground planes 50, 82 and 102 provide signal isolation between the antenna structures. Two or more of the antenna structures 40, 80 and 100 can be placed on the window glass at different locations and receive the same frequency signals to provide the MIMOs signal reception, where the antenna structures 40, 80 and 100 can be mixed and matched for different applications.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. An antenna structure comprising:

a dielectric structure;

a thin film substrate adhered to the dielectric structure by an adhesive layer; and a planar antenna formed on the thin film substrate opposite to the adhesive layer, said planar antenna including a ground plane having an elliptical cut-out slot section defined within an outer perimeter portion of the ground plane, said antenna further including an antenna radiating element extending into the slot from the perimeter portion; wherein the antenna radiating element is at least one of a hexagonal-shaped antenna radiating element, and a U-shaped antenna radiating element.

2. The antenna structure according to claim 1 wherein the ground plane is conductive having a continuous outer perimeter portion with the slot formed therein being a partial slot, the radiating element including a feed portion positioned within the partial slot.

3. The antenna structure according to claim 1 wherein the thin film substrate, adhesive layer and a planar antenna are formed and an adhesive applique, wherein the applique may be adhered to the dielectric structure after the fabrication of the dielectric structure.

4. The antenna structure according to claim 1 further comprising a feed structure electrically coupled to the perimeter portion and the antenna element.

5. The antenna structure according to claim 4 wherein the feed structure is a co-planar waveguide feed structure.

6. The antenna structure according to claim 5 further comprising a coaxial connector connected to the co-planar waveguide feed structure.

7. The antenna structure according to claim 1 wherein the perimeter portion is square.

8. The antenna structure according to claim 1 wherein the dielectric structure is a vehicle window.

9. The antenna structure according to claim 8 wherein the vehicle window is a vehicle windshield.

10. The antenna structure according to claim 1 wherein the antenna includes transparent conductors.

11. The antenna structure according to claim 1 wherein the thin film substrate is selected from the group consisting of mylar, Kapton, PET and flexible glass substrates.

12. The antenna structure according to claim 1 wherein the antenna provides signals for a multiple-input multiple output (MIMO) long term evolution (LTE) cellular system operating in the 0.46 -3.8 GHz frequency band.

13. The antenna structure according to claim 1 , the dielectric structure having an outer layer and an inner layer with a polyvinyl butyral (PVB) layer between the inner layer and the outer layer, the thin film substrate adhered to the inner layer wherein the thin film substrate is adhered to an interior surface of the inner layer of the dielectric structure.

14. The antenna structure according to claim 13 wherein the dielectric structure is a vehicle window.

15. The antenna structure according to claim 14 wherein the vehicle window is a vehicle windshield.

16. An antenna structure comprising:

a vehicle window;

a thin film substrate adhered to the vehicle window by an adhesive layer; and a planar antenna formed on the thin film substrate opposite to the adhesive layer, said planar antenna including a ground plane having an elliptical cut-out slot section defined within an outer perimeter portion of the ground plane, said antenna further including an antenna radiating element extending into the slot from the perimeter portion; wherein the antenna radiating element is at least one of a hexagonal-shaped antenna radiating element, and a U-shaped antenna radiating element, and wherein the antenna provides signals for a multiple-input multiple output (MIMO) long term evolution (LTE) cellular system operating in the 0.46-3.8 GHz frequency band.

17. The antenna structure according to claim 16 wherein the ground plane is conductive having a continuous outer perimeter portion with the slot formed therein being a partial slot , the radiating element including a feed portion positioned within the partial slot.

18. The antenna structure according to claim 16 wherein the thin film substrate, adhesive layer and a planar antenna are formed and an adhesive applique, wherein the applique may be adhered to the dielectric structure after the fabrication of the dielectric structure.

19. The antenna structure according to claim 16 wherein the vehicle window is a vehicle windshield.

20. The antenna structure according to claim 16 wherein the antenna includes transparent conductors.

21. An antenna structure comprising:

a dielectric structure;

a thin film substrate adhered to the dielectric structure by an adhesive layer;

a planar antenna formed on the thin film substrate opposite to the adhesive layer, said planar antenna including a ground plane having an elliptical cut-out slot section defined within an outer perimeter portion of the ground plane, said antenna further including at least one of a hexagonal-shaped antenna radiating element, and a U-shaped antenna radiating element extending into the slot from the perimeter portion; and a co-planar waveguide feed structure comprising a feed structure slot in the ground plane open to the elliptical cut-out slot and a signal line extending from the antenna element into said feed structure slot, wherein said feed structure slot and said signal line are substantially aligned along the minor axis of the elliptical cut-out slot.

* * * * *